United States Patent [19]

Schneider et al.

[11] Patent Number: 4,735,066

[45] Date of Patent: Apr. 5, 1988

[54] FLAT KNITTING MACHINE WITH BOBBIN HOLDERS

[75] Inventors: Herbert Schneider, Eningen; Ernst Goller, Reutlingen; Adam Mueller, Reutlingen-Oferdingen, all of Fed. Rep. of Germany

[73] Assignee: H. Stoll GmbH & Co., Reutlingen, Fed. Rep. of Germany

[21] Appl. No.: 106,357

[22] Filed: Oct. 9, 1987

[30] Foreign Application Priority Data

Oct. 10, 1986 [DE] Fed. Rep. of Germany ..... 3634578

[51] Int. Cl.[4] ..... D04B 7/04

[52] U.S. Cl. ..... 66/125 R

[58] Field of Search ..... 66/125 R

[56] References Cited

U.S. PATENT DOCUMENTS

| | | | |
|---|---|---|---|
| 3,461,691 | 8/1969 | Ballard | 66/125 R |
| 3,962,890 | 6/1976 | Krause | 66/125 R |
| 4,043,154 | 8/1977 | Merkle | 66/125 R |
| 4,467,624 | 8/1984 | Schimko | 66/125 R |
| 4,679,413 | 7/1987 | Müller et al. | 66/125 R |

FOREIGN PATENT DOCUMENTS

| | | | |
|---|---|---|---|
| 2333687 | 1/1975 | Fed. Rep. of Germany | 66/125 R |

*Primary Examiner*—Ronald Feldbaum

*Attorney, Agent, or Firm*—Larson and Taylor

[57] ABSTRACT

The flat knitting machine (10) has, on the rear side of its machine body (12), bobbin holders for additional bobbins (19), the yarn of which can be processed on the same flat knitting machine or on an adjacent flat knitting machine (10'). The additional bobbin holders can be arranged on individually removable rear-wall panels of the flat knitting machine (10) (FIG. 1).

7 Claims, 2 Drawing Sheets

FLAT KNITTING MACHINE WITH BOBBIN HOLDERS

DESCRIPTION

The invention relates to a flat knitting machine with needle beds accessible from its front, with bobbin holders and with thread guide rails arranged above the machine body.

On flat knitting machines, it is customary to arrange the bobbins in one or more tiers above the machine body and draw off the threads from there in the direction of the needle-bed ends. It is also known from circular knitting machines to erect separate bobbin carriers next to the knitting machine and from there feed the threads to the knitting machine over and beyond the head of an attendant. The erection of additional bobbin carriers next to a flat knitting machine takes up a large amount of space. The disadvantage of arranging the bobbins in several tiers above the machine body is that the attendant can reach the bobbin holders only by means of a ladder, in order to exchange the bobbins and repair thread breaks.

The object on which the invention is based is to design a flat knitting machine in such a way that it can be equipped with a larger number of bobbin holders than hitherto, all these still being readily accessible, without a bobbin carrier separate from the machine body being necessary for this purpose.

On a flat knitting machine of the type mentioned in the introduction, the set object is achieved, according to the invention, because at least some of the bobbin holders are arranged on the rear side of the machine body. The bobbin holders can be arranged in mutually offset rows or double rows on the rear side of the machine body, preferably in a vertical plane, so as to save space, each bobbin holder having assigned to it at least one thread guide member which ensures that the thread or yarn is carried away upwards from the bobbin.

A considerable number of additional bobbin holders can be arranged on the rear side of the long flat knitting machines, and the yarn supply can thus be increased substantially. All the bobbin holders arranged on the rear side of the flat knitting machine are readily accessible. The bobbins can be attached and exchanged easily by an attendant, without the use of a ladder. Advantageously, the bobbin holders can be arranged distributed on several individually removable rear-wall panels of the flat knitting machine, so that the interior of the machine body remains accessible as a result of the removal of the individual rear-wall panels.

The invention has an especially advantageous effect in machine rooms where the flat knitting machines are arranged in several rows. Here, the threads from the bobbins arranged on the rear side of one flat knitting machine can be guided overhead to a flat knitting machine of the adjacent row. For this purpose, according to the invention, above its machine body the flat knitting machine can also have, on its rear side, an assembly rail extending in the longitudinal direction of the machine and intended for fastening thread monitors. With this type of thread guidance, an attendant merely needs to turn round in order to reach the additional bobbins arranged on the rear side of the adjacent flat knitting machine. When the aisles between the individual rows of machines are narrow, removable transparent protective covers having orifices at the top for drawing off the thread can also be attached in front of the bobbins arranged on the rear side.

An exemplary embodiment of a flat knitting machine designed according to the invention is explained in detail below with reference to the accompanying drawing.

Figure 1:
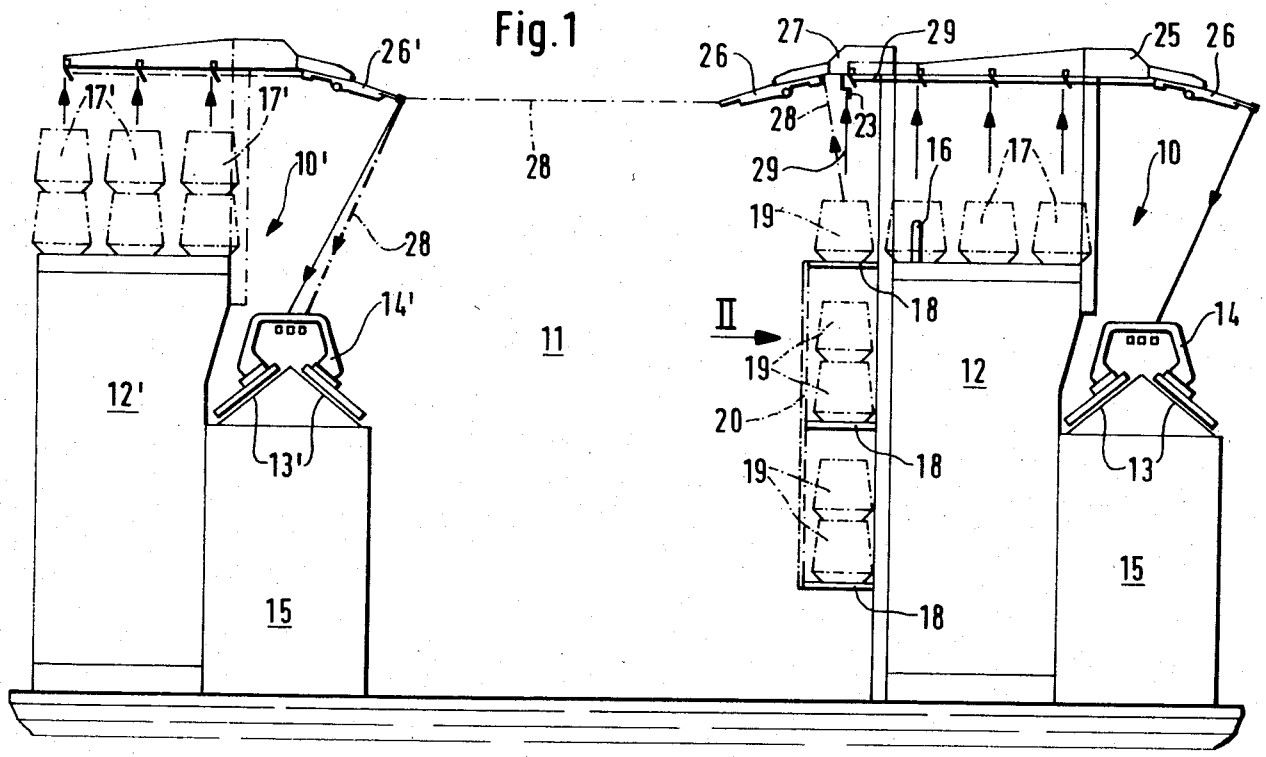
FIG. 1 shows a diagrammatic end view of two flat knitting machines arranged parallel to and at a distance from one another.

FIG. 1 illustrates two flat knitting machines 10 and 10' which are arranged parallel to and at a distance from one another, thereby forming an aisle 11. At the front of its machine body 12, 12', the needle beds 13, 13', over which a machine slide 14 is moved, are arranged in a known way above a receiving space 15 for the knitted article produced. Also in a known way, three rows of bobbin holders 16 are arranged on the top side of the machine body 12 of the flat knitting machine 10, and accordingly three rows of bobbins 17 are provided. On the flat knitting machine 10', the bobbins 17' are arranged in two tiers on double bobbin holders, not shown in detail, and are likewise arranged in three rows on the top side of the machine body 12'.

Figure 2:
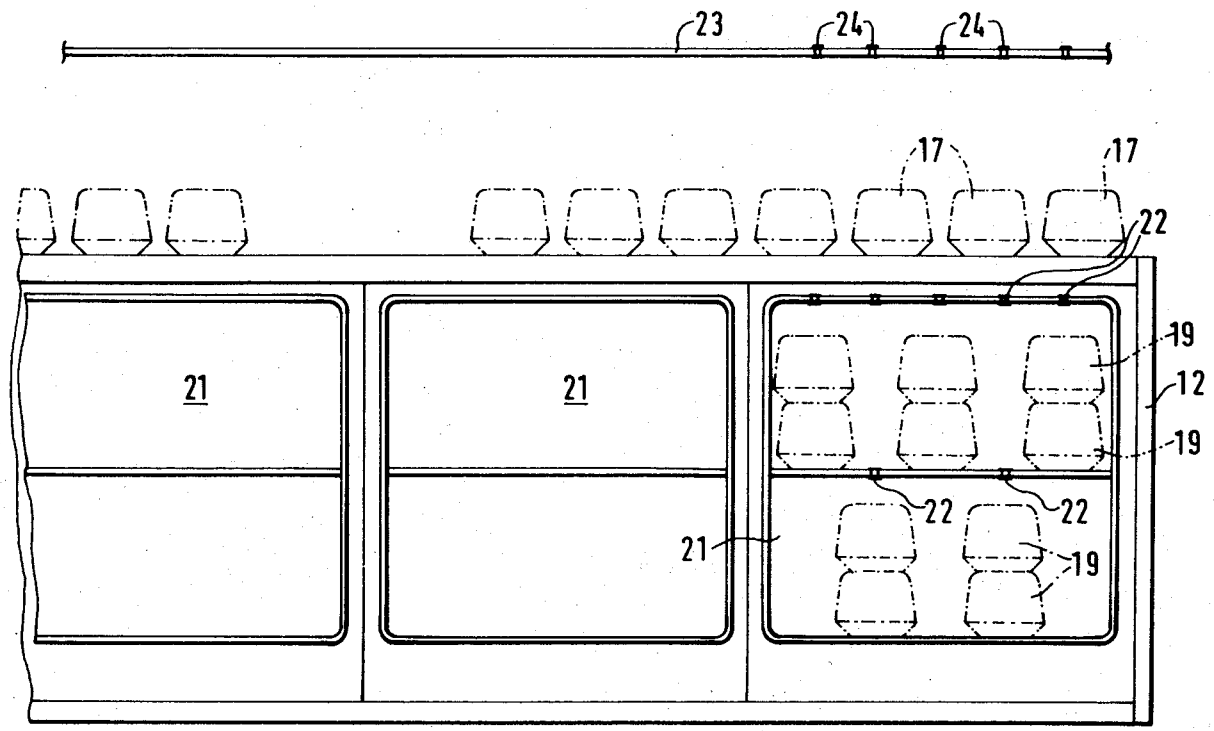
FIG. 2 shows a part view of the rear side of one of the two flat knitting machines in the direction of the arrow II of FIG. 1.

On the flat knitting machine 10, additional bobbin holders 18 for additional bobbins 19 are provided in a vertical plane on the rear side of the machine body 12. They can be shielded by means of a transparent removable protective wall 20 indicated by means of dot-and-dashed lines. As shown in FIG. 2, the additional bobbin holders located on the rear side and intended for the additional bobbins 19 are formed on individual rear-wall panels 21 of the machine body 12 and can be removed, together with these rear-wall panels 21, from the machine body 12. By means of thread guide eyes 22 evident from FIG. 2, of which at least one is assigned to each additional bobbin holder or bobbin 19, the threads are drawn off upwards from the additional bobbins 19 in the direction of an upper thread guide rail 23 likewise equipped with thread guide eyes 24. According to FIG. 1, the flat knitting machine 10 not only is equipped, at the front, with an assembly rail 25 extending in the longitudinal direction of the machine and intended for thread monitors 26, but also has a corresponding assembly rail 27 for thread monitors 26 at the rear. The threads drawn off upwards from the additional bobbins 19 in the direction of the thread guide rail 23 can thus also be guided to rear thread monitors 26 and conveyed from these thread monitors or directly from the thread guide rail 23 over and beyond the aisle 11 to front thread guides 26' of the adjacent flat knitting machine 10'. In FIG. 1, a thread drawn off from an upper additional bobbin 19 and guided to the adjacent flat knitting machine 10' via a rear thread monitor 26 is represented by a dot-and-dashed line and is designated by the reference numeral 28. Moreover, an unbroken line bearing the reference numeral 29 denotes a thread drawn off from a lower additional bobbin 19 and guided to the front of the flat knitting machine 10 via the thread guide rail 23.

The additional bobbin holders can have any form fitting the bobbins or double bobbins used, even a known form, and appropriately are arranged in mutually offset rows or double rows on the rear-wall panels 21 of the flat knitting machine. The additional bobbin holders 18 can also be arranged so that the additional bobbins 19 are attached in an oblique position.

We claim:

1. Flat knitting machine with needle beds accessible from its front, with bobbin holders and with thread guide rails arranged above the machine body, characterized in that at least some of the bobbin holders (16) are arranged on the rear side of the machine body (12).

2. Flat knitting machine according to claim 1, characterized in that at least one thread guide member (22) for carrying the thread or yarn (28, 29) away upwards is assigned to each of the bobbin holders arranged on the rear side of the machine body (12).

3. Flat knitting machine according to claim 1 characterized in that, above its machine body (12), it also has, along the rear side of the machine, an assembly rail (27) which is fitted with thread monitors (26) and which allows the thread to be guided to an adjacent parallel flat knitting machine.

4. Flat knitting machine according to claim 1, characterized in that the bobbin holders for the additional bobbins (19) are arranged in mutually offset rows or double rows on the rear side of the machine body (12).

5. Flat knitting machine according to one of claim 1, characterized in that the bobbin holders located on the rear side are arranged in a vertical plane.

6. Flat knitting machine according to claim 1, characterized in that the bobbin holders for the additional bobbins (19) are arranged distributed in groups on several individually moveable rear-wall panels (21) of the flat knitting machine.

7. Flat knitting machine according to claim 1, characterized in that removable transparent protective covers (20) having orifices at the top for carrying away the yarn are attached in front of the bobbins (19) arranged on the rear side.

* * * * *